US008096118B2

(12) United States Patent
Williams

(10) Patent No.: US 8,096,118 B2
(45) Date of Patent: Jan. 17, 2012

(54) ENGINE FOR UTILIZING THERMAL ENERGY TO GENERATE ELECTRICITY

(76) Inventor: Jonathan H. Williams, Griffin, GA (US)

( * ) Notice: Subject to any disclaimer, the term of this patent is extended or adjusted under 35 U.S.C. 154(b) by 449 days.

(21) Appl. No.: 12/362,651

(22) Filed: Jan. 30, 2009

(65) Prior Publication Data

US 2010/0192566 A1 Aug. 5, 2010

(51) Int. Cl.
*F01B 29/10* (2006.01)

(52) U.S. Cl. ..... 60/519; 60/525

(58) Field of Classification Search ..... 60/517, 60/519, 525

See application file for complete search history.

(56) References Cited

U.S. PATENT DOCUMENTS 3,074,244 A 1/1963 Malaker et al.
3,397,533 A 8/1968 Steiner et al.
3,457,722 A 7/1969 Bush
3,478,695 A 11/1969 Goranson et al.
3,513,659 A 5/1970 Martini
3,563,028 A 2/1971 Goranson et al.
3,604,821 A 9/1971 Martini
3,667,215 A 6/1972 Rao
3,767,325 A * 10/1973 Schuman ..... 417/207
3,791,473 A 2/1974 Rosen
3,822,388 A 7/1974 Martini et al.
3,886,744 A 6/1975 Jaspers
3,959,971 A 6/1976 Mekari
3,996,745 A 12/1976 Davoud et al.
4,026,114 A 5/1977 Belaire
4,070,860 A 1/1978 Hanson
4,093,239 A 6/1978 Shgahara
4,099,448 A * 7/1978 Young ..... 91/339
4,133,172 A 1/1979 Cataldo
4,176,655 A 12/1979 Levy
4,312,181 A * 1/1982 Clark ..... 60/519
4,333,424 A 6/1982 McFee
4,345,437 A 8/1982 Dineen
4,350,012 A 9/1982 Folsom et al.
4,364,233 A 12/1982 Stang
4,380,152 A 4/1983 Folsom et al.
4,387,566 A 6/1983 Berchowitz
4,458,495 A 7/1984 Beale
4,489,554 A 12/1984 Otters
4,583,364 A 4/1986 Wood
4,622,813 A 11/1986 Mitchell
4,649,283 A 3/1987 Berchowitz et al.
4,715,183 A 12/1987 Meijer et al.
4,738,106 A 4/1988 Yamaguchi
4,753,073 A * 6/1988 Chandler ..... 60/519
4,785,209 A 11/1988 Sainsbury
4,805,408 A 2/1989 Beale et al.
4,873,826 A 10/1989 Dhar
4,945,726 A 8/1990 Beale
4,996,841 A 3/1991 Meijer et al.
5,085,054 A 2/1992 Katsuda et al.
5,156,121 A 10/1992 Routery
5,203,170 A 4/1993 Naito
5,211,017 A 5/1993 Pusic (Continued)

*Primary Examiner* — Hoang Nguyen
(74) *Attorney, Agent, or Firm* — Merchant & Gould P.C.

(57) ABSTRACT

Disclosed are systems and methods for generating power. The system includes a sealed chamber, a displacer located inside the chamber, a magnetic mechanism to actuate the displacer, and a linear alternator. The chamber includes a first side, a first top surface, and a first bottom surface, the first side located adjacent to a heat source and the second side adjacent to a heat sink. The displacer includes a pivot surface, a rocker, or a slide, and may include a regenerator.

26 Claims, 7 Drawing Sheets

U.S. PATENT DOCUMENTS 5,383,334 A 1/1995 Kaminishizono et al.
5,435,136 A 7/1995 Ishizaki et al.
5,502,968 A 4/1996 Beale
5,557,934 A 9/1996 Beach
5,873,246 A 2/1999 Beale
5,884,481 A 3/1999 Johansson et al.
5,893,275 A 4/1999 Henry
5,920,133 A 7/1999 Penswick et al.
5,987,894 A 11/1999 Claudet
6,062,023 A 5/2000 Kerwin et al.
6,071,087 A 6/2000 Jalink, Jr. et al.
6,122,909 A 9/2000 Murphy et al.
6,314,731 B1 11/2001 Tigane
6,381,958 B1 5/2002 Kamen et al.
6,389,811 B2 5/2002 Urasawa et al.
6,457,309 B1 10/2002 Firey
6,463,731 B1 10/2002 Warren
6,474,075 B1 11/2002 Tanaka et al.
6,475,935 B1 11/2002 Ishizaki et al.
6,507,126 B1 1/2003 Laqua et al.
6,510,689 B2 1/2003 Budliger
6,513,326 B1 2/2003 Maceda et al.
6,526,750 B2 3/2003 Bliesner et al.
6,536,207 B1 3/2003 Kamen et al.
6,536,326 B2 3/2003 Unger et al.
6,543,215 B2 4/2003 Langenfeld et al.
6,543,216 B2 4/2003 Asai et al.
6,543,229 B2 4/2003 Johansson
6,564,551 B1 5/2003 Stock
6,564,552 B1 5/2003 Ward et al.
6,568,169 B2 5/2003 Conde et al.
6,578,359 B2 6/2003 Ban et al.
6,591,609 B2 7/2003 Kamen et al.
6,606,849 B1 8/2003 Salter et al.
RE38,337 E 12/2003 Beale
6,668,809 B2 12/2003 Lowi, Jr. et al.
6,672,063 B1 1/2004 Proeschel
6,694,731 B2 2/2004 Kamen et al.
6,698,200 B1 3/2004 Rauen
6,701,708 B2 * 3/2004 Gross et al. ..... 60/517
6,701,709 B2 3/2004 Isaac, Jr. et al.
6,701,721 B1 3/2004 Berchowitz
6,715,285 B2 4/2004 Isaac, Jr.
6,717,297 B2 4/2004 Sadarangani et al.
6,729,131 B2 5/2004 Kocsisek
6,732,785 B2 5/2004 Mitchell
6,748,907 B2 6/2004 Malmquist et al.
6,779,342 B2 8/2004 Tanaka
6,786,045 B2 9/2004 Letovsky
6,809,434 B1 10/2004 Duncan et al.
6,810,665 B2 11/2004 Chien et al.
6,815,847 B2 11/2004 Duncan et al.
6,817,221 B1 11/2004 Cale
6,841,900 B2 1/2005 Corey
6,843,057 B2 1/2005 Yamamoto
6,854,509 B2 2/2005 Mitchell
6,856,107 B2 2/2005 Daboussi
6,857,260 B2 2/2005 Langenfeld et al.
6,857,267 B2 2/2005 Yamagiri et al.
6,862,883 B2 3/2005 Kamen et al.
6,864,647 B2 3/2005 Duncan et al.
6,865,887 B2 3/2005 Yamamoto
6,871,495 B2 3/2005 Lynch et al.
6,874,321 B2 4/2005 Ogura
6,877,314 B2 4/2005 Pels
6,886,339 B2 5/2005 Carroll et al.
6,899,075 B2 5/2005 Saint-Hilaire et al.
6,901,755 B2 6/2005 Corey et al.
6,907,730 B2 6/2005 Kiikka
6,907,735 B2 6/2005 Wolff et al.
6,910,331 B2 6/2005 Asai et al.
6,914,351 B2 7/2005 Chertok
6,920,967 B2 7/2005 Wood
6,930,414 B2 8/2005 Qiu
6,931,848 B2 8/2005 Maceda et al.
6,945,043 B2 9/2005 Okano et al.
6,952,921 B2 10/2005 Qiu
6,966,182 B2 11/2005 Kamen et al.
6,968,688 B2 11/2005 Gimsa
6,971,236 B2 12/2005 Richardson et al.
6,975,060 B2 12/2005 Styblo et al.
6,978,610 B2 12/2005 Carnahan
6,979,911 B2 12/2005 Otting et al.
6,990,810 B2 1/2006 Pellizzari et al.
6,996,983 B2 2/2006 Cameron
7,000,390 B2 2/2006 Wood
7,007,469 B2 3/2006 Bliesner
7,013,633 B2 3/2006 Dicic
7,013,639 B2 3/2006 Hamman
7,013,640 B2 3/2006 Gregory et al.
7,021,054 B2 4/2006 Alderson et al.
7,028,473 B2 4/2006 Servis et al.
7,043,909 B1 5/2006 Steele
7,075,292 B2 7/2006 Berchowitz et al.
7,076,941 B1 7/2006 Hoffman et al.
7,122,919 B2 10/2006 Maezawa et al.
7,134,279 B2 11/2006 White et al.
7,152,407 B2 12/2006 Jobson
7,181,912 B2 2/2007 Mori
2003/0074897 A1 4/2003 Rollston
2004/0025502 A1 2/2004 Okano et al.
2005/0274111 A1 12/2005 Yaguchi et al.

* cited by examiner

ENGINE FOR UTILIZING THERMAL ENERGY TO GENERATE ELECTRICITY

FIELD OF INVENTION

The present disclosure relates to systems and methods for capturing energy from direct and waste thermal sources. More particularly, the present disclosure relates to systems and methods for producing electricity by extracting energy from hot gases such as exhaust gas generated by internal combustion engines and from solar concentrators.

BACKGROUND

Two major classes of engines are used to convert heat energy to mechanical energy and/or electrical energy—these being internal combustion (IC) and external combustion (EX) engines. Internal combustion engines dominate the transportation industry while the major applications of external combustion engines are found in the power generation industry where steam powered turbines are still a major application of the external combustion principle.

Stirling engines (SE) are external combustion engines with higher energy density than piston-based steam engines that may be as energetically efficient as internal combustion engines. Like steam power, SE's suffer relative to IC engines in having less dynamic power output; thus they are commonly found in applications where the power demand is relatively constant. The SE is a thermodynamic engine that delivers power by alternatively heating and cooling a fixed volume of gas with work being done by the pressure increase during the heating phase. A number of arrangements for achieving the alternate heating and cooling of the working fluid (i.e. a gas) have been developed, giving rise to three main forms of the engine (alpha, beta and gamma). In these traditional configurations and commercialized arrangements of a SE, the mechanical work is usually produced by the pressure of the heated gas acting on piston-crankshaft arrangements. The heat exchange surface is the surface of the cylinder(s) but mostly the cylinder head(s). Rotating SE's with crankshaft/piston designs require special seals, or provision to regenerate and recharge the working gas as it is lost through the joints provided for lubrication and power transfer.

SUMMARY

One aspect of the present disclosure relates to systems for generating electrical power by utilizing heat. Another aspect of the present disclosure relates to methods for generating electrical power by utilizing heat.

This Summary is provided to introduce a selection of concepts in a simplified form that are further described below in the Detailed Description. This Summary is not intended to identify key features or essential features of the claimed subject matter. Nor is this Summary intended to be used to limit the claimed subject matter's scope.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION

Various embodiments are described more fully below with reference to the accompanying drawings, which form a part hereof, and which show specific embodiments of the invention. However, embodiments may be implemented in many different forms and should not be construed as limited to the embodiments set forth herein; rather, these embodiments are provided so that this disclosure will be thorough and complete, and will fully convey the scope of the invention to those skilled in the art. Therefore, the following detailed description is not to be taken in a limiting sense.

Conceptually, one embodiment of the present disclosure is a non-cylindrical external combustion engine utilizing the Stirling cycle consisting of a flue (or plurality of flues) through which either the heating (hot combustion gases) or cooling (ambient air or water) fluid passes to respectively heat or cool the appropriate surface of chambers containing a displacer that may be positioned magnetically to expose the working fluid to either the heated or cooled surface.

Figure 1:
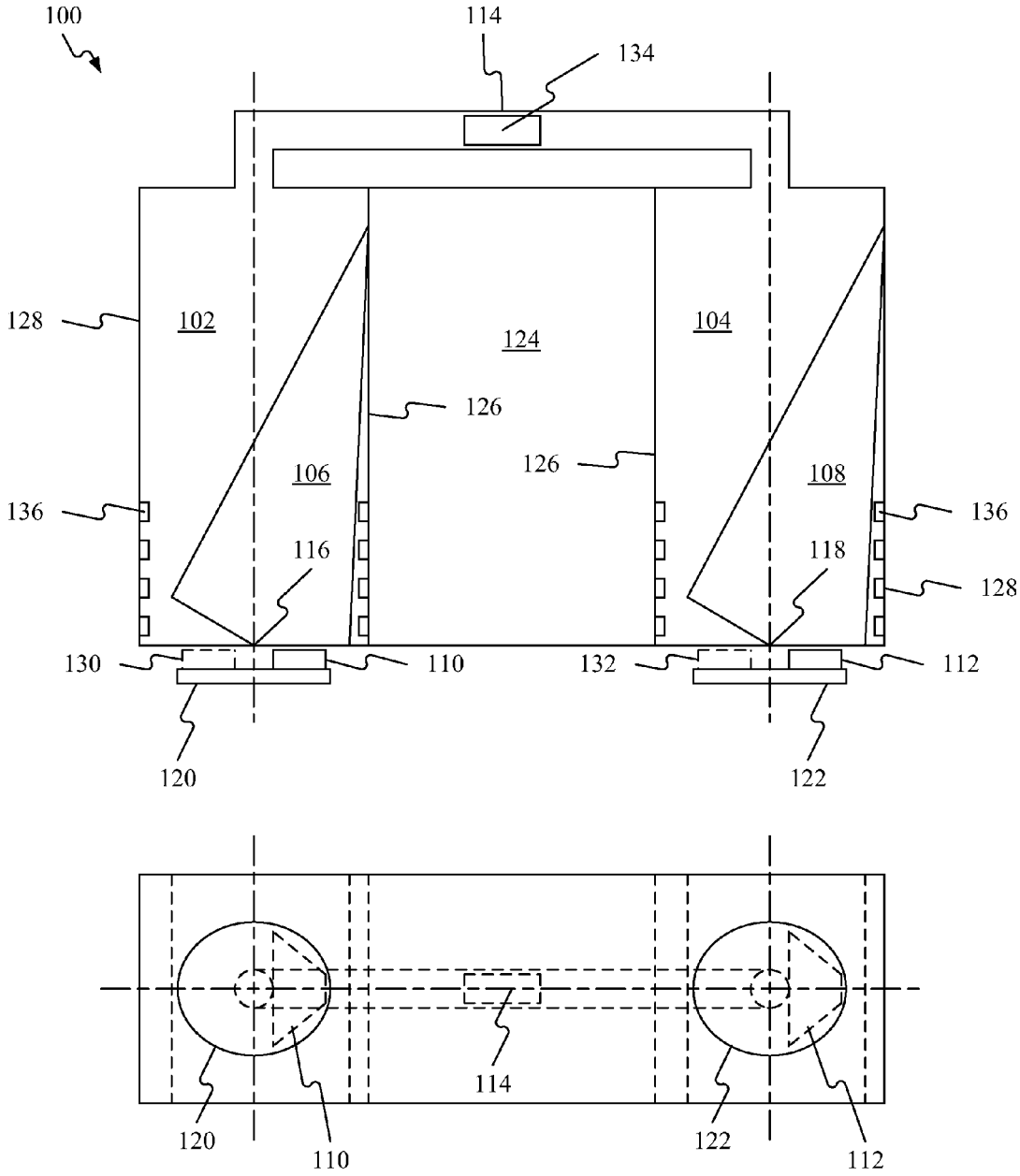
FIG. 1 is a diagram of a dual chamber engine for utilizing waste exhaust heat to generate electricity.

Turning now to the figures, FIG. 1 illustrates a section dual chamber engine 100 for utilizing gaseous heat (e.g. IC engine exhaust) to generate electricity. The dual chamber engine 100 includes two chambers 102 and 104 of any length, two baffles 106 and 108, magnets 110 and 112, and a linear alternator 114. The chambers 102 and 104 are connected in fluid communication with one another via a conduit of the linear alternator 114. In addition, passing between the chambers 102 and 104 is a heat source such as an exhaust conduit for conveying exhaust gas that is warmer than ambient air. In one embodiment, the conduit carries exhaust gas from an internal combustion engine such as a diesel engine or a spark ignition engine. The conduit can replace the exhaust pipe, muffler and catalytic converter allowing the capture of presently wasted energy. This capturing of otherwise wasted energy could lead to an increase in the energy efficiency of fossil fuel used.

Any heat source can be used to power the dual chamber engine 100, particularly since the large heat exchange surface potential allows for efficient function when the temperature differential is low. The heat source may be solar radiation which can be concentrated onto a single side or onto both sides of an engine with the cooling flue being in the center. The heat exchange surface may include structures 136 for increasing surface area available for heat transfer such as fins, bumps, projections, curved surfaces, and other forms of extended surfaces. Moreover, regenerator assemblies may be located on surfaces in the chambers 102 and 104 in the path of displaced working gases to increase heat capture efficiency as the working fluid is moved by the articulated movement of the baffles 106 and 108. The chambers 102, 104, and flue 124 and the baffles 106 and 108 may be constructed from pressed/rolled metal welded at the seams to minimize gas leakage problems.

The chambers 102 and 104 have two opposing sides 126 and 128 that are identified as the heated and cooled surfaces, respectively. The power output of SE's is determined by the temperature difference between the internal heat exchange surfaces, the amount of gas displaced between the heated and cooled chambers, and the frequency of the cycle, the greatest efficiency of energy capture will be provided by a high exchange surface-chamber volume ratio which will maximize the cycle frequency. For instance a square tube of 2×2 cm has half the exchange surface area of a 4×1 cm tube while having the same volume of working gas. Sides 126 are heated by the heating medium and sides 128 are cooled by ambient air or other fluid cooler than the heat source. The simplest configuration would be a rectangular section tube but compound curves and corrugations are possible and may achieve savings of materials in manufacture. The material for construction of the chambers 102 and 104 may be non-magnetic within the vicinity of the magnet displacer drive to allow the action of the external magnets on the internal displacer. For example, the chambers 102 and 104 may be constructed from non-magnetic stainless steel, aluminum, or other materials that do not exhibit ferromagnetic properties such as plastics and ceramics.

The baffles 106 and 108 act as displacers to displace the working fluid in the chambers 102 and 104 thereby determining whether the working fluid is heated or cooled. Note that while FIG. 1 depicts the baffles 106 and 108 having a rhombic shape, baffles 106 and 108 may be of differing shape such as, but not limited to, rectangular and various curved shapes to match surfaces 126 and 128. For example, the outer and inner walls of the chambers 102 and 104 may have profiles to match the profile of the corresponding surface of the baffles 106 and 108. In various aspects of the disclosure, the baffles 106 and 108 are configured such that during operation they pivot about points 116 and 118, respectively. For example, the baffles 106 and 108 may be constructed such that at least a portion of the baffles 106 and 108 exhibit ferromagnetic properties (i.e. are attracted and/or repelled to poles of magnets) and magnets 110 and 112 may act on these ferromagnetic portions to cause the baffles 106 and 108 to pivot. Note that when the baffles 106 and 108 pivot, the working fluid flows from one side of the chambers 102 and 104, respectively. In other words, as show in FIG. 1, the working fluid being heated and cooled are located on the left side of the chambers 104 and 106 respectively. When the baffles 106 and 108 pivot about points 116 and 118, the working fluid will flow from the left sides of the chambers 102 and 104 to the right side of the chambers 102 and 104. The operation of the dual chamber engine 100 will be described in greater detail below with respect to FIG. 2. In addition, the baffles 106 and 108 may be supplemented with one or more valves to assist in controlling the movement of the working fluid.

The magnets 110 and 112 may be fixed magnets or electromagnets. In addition, the magnets may be stationary or movable. For example, as shown in FIG. 1, the magnets 110 and 112 may be mounted to turntables 120 and 122 such that during operation the magnets 110 and 112 can change positions. The turntables 120 and 122 may be powered from electricity generated by the linear alternator 114. In addition, when magnets 110 and 112 are electromagnets, they may receive power from the linear alternator 114 or any other source. Note that while FIG. 1 shows only two magnets, any number of turntables and magnets may be used depending on the length and dimensions of the chambers. For example, magnets 110 and 112 may be electromagnets and two additional electromagnets 130 and 132 (represented by dashed lines) may be used control the movement of the baffles 106 and 108. The operation of the dual chamber engine 100 with electromagnets will be described in greater detail below with respect to FIG. 5.

Figure 2:
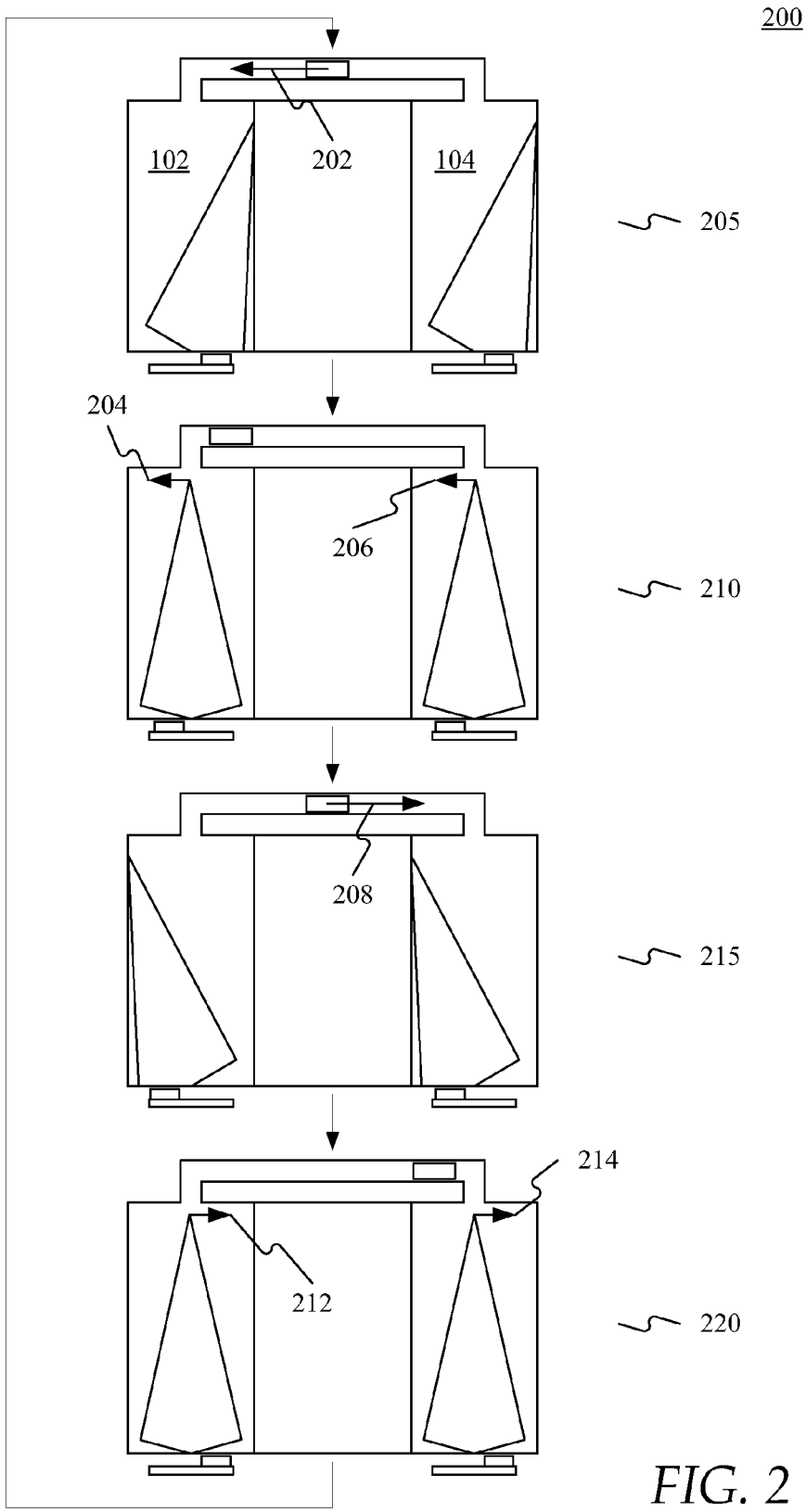
FIG. 2 is a flow chart of a cycle for utilizing waste heat to generate electricity with a two chambered engine.

Turning now to FIG. 2, FIG. 2 is a flow chart setting forth the general stages of a cycle 200 for utilizing heat to generate electricity with the dual chamber engine 100. The cycle 200 begins at stage 205 with the baffles 106 and 108 positioned so that as hot exhaust passes through the exhaust flue 124, heat is transferred from the exhaust to a working gas located in the chamber 104. While the gas in chamber 104 is being heated by the outer surface of the exhaust flue, the gas in chamber 102 is being cooled by contact to with surface 128 which is cooled to act as a heat sink. As the gas in the chamber 104 is heated by the hot exhaust, the gas expands. Simultaneously, the gas in chamber 102 contracts due to cooling. This combination of expansion/contraction causes the working gas to displace the piston of the linear alternator from chamber 104 towards chamber 102 causing a magnet 134 of the linear alternator to slide through or past coils in a direction 202 thereby generating electricity. Generally, a linear alternator generates an alternating electrical current (AC) by passing a reciprocating magnet in a linear direction through a coil of wires. Greater detail of the operation of a linear alternator can be found in U.S. Pat. Nos. 6,369,469, 5,180,939, 5,175,457, 5,146,123, 4,649,283, and 4,642,547, all of which are incorporated by reference in their entirety.

Once the magnet in the linear alternator 114 reaches a certain position, the cycle 200 proceeds to stage 210. In stage 210, the magnets 110 and 112 are repositioned to cause the baffles 106 and 108 to change positions as indicated by arrows 204 and 206. While FIG. 2 shows the magnets being repositioned, it should be understood that the magnets may be electromagnets and to change the baffles' 106 and 108 positions, various magnets may be activated and deactivated, or their polarity reversed (See FIG. 5). In other aspects of the disclosure, positioning of the baffles 106 and 108 may be controlled by sensors. The sensors may monitor the temperature differential, the pressure of the working fluid, or position of the linear alternator's 114 magnet. The sensors may receive power from the linear alternator 114 or any other source.

Once the baffles 106 and 108 have changed positions, the cycle 200 proceeds to stage 215. In stage 215, the hot exhaust in the exhaust flue 124 will heat the gas in the chamber 102. As the gas in the chamber 102 absorbs heat, it will expand and drive the magnet(s) in the linear alternator in the direction of arrow 208 thereby generating AC electricity.

Once the magnet in the linear alternator 114 reaches a certain position the cycle 200 proceeds to stage 220. In stage, 220 the magnets 110 and 112 are repositioned to cause the baffles 106 and 108 to change positions as indicated by arrows 212 and 214. After the baffles 106 and 108 have changed positions, the cycle 200 proceeds to stage 205 where the cycle 200 begins again.

Figure 3:
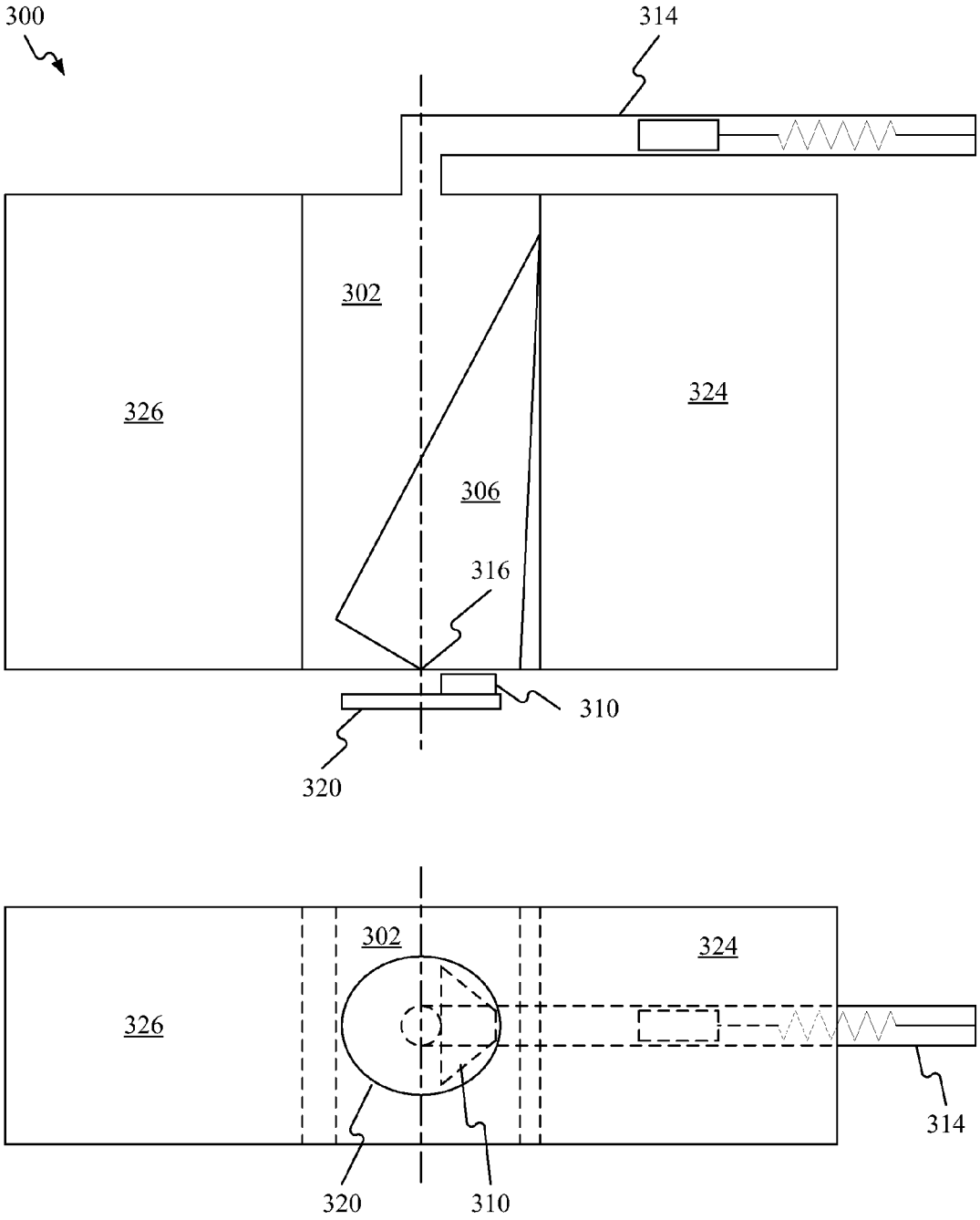
FIG. 3 is a diagram of a single chamber engine for utilizing a heat source to generate electricity.

FIG. 3 is a diagram of a single chamber engine 300 for utilizing waste exhaust heat to generate electricity. The single chamber engine 300 includes a chamber 302, a baffle, 306, a magnet 310, and a linear alternator 314. On opposite sides of the chamber 302 is a heat source 324 (e.g., an exhaust conduit from an internal combustion engine) and cooling structure 326 (e.g., ambient air or another cooling fluid having a temperature lower than the fluid of the heat source). As stated above with regards to FIG. 1, regenerators and sensors may be used to increase heat conversion efficiencies and control positioning of the baffle 306.

Note that while FIGS. 1 and 3 depicts the baffle 106 and 306 having a triangular shape, the baffle 106 may be of differing shapes such as, but not limited to, rectangular and various curved shapes. In various aspects of the disclosure, the baffle 306 is configured such that during operation it pivots about point 316. The operation of the single chamber engine 300 will be described in greater detail below with respect to FIG. 4.

As above with the dual chamber engine 100, the magnet 310 may be a fixed magnet or one or more electromagnets. In addition, the magnets may be stationary or movable. For example, as show in FIG. 3, the magnet 310 may be mounted to a turntable 320 such that during operation the magnet 310 can change positions. In electromagnetic versions of the drive for the baffles this may be achieved by switching polarity of the magnet.

In various applications, including but not limited to, a solar application, electricity generated could be used for a home while water used for cooling would leave the system heated. This type of system could provide a dual value for homes and industry. In addition, two inline chambers could be utilized with the linear alternator 114 working at the junction.

Figure 4:
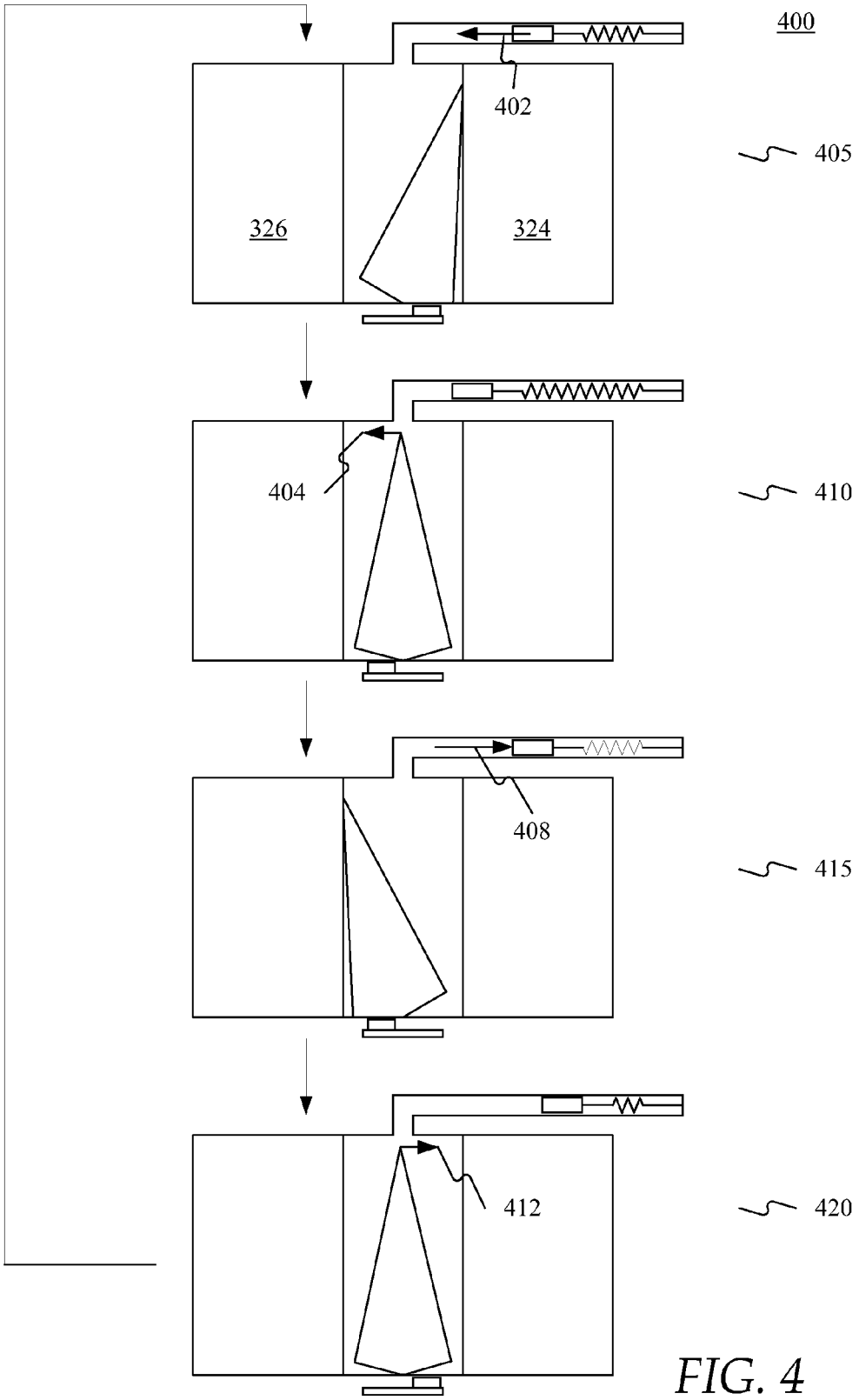
FIG. 4 is a flow chart of a cycle for utilizing heat with a single chamber engine to generate electricity.

Turning now to FIG. 4, FIG. 4 is a flow chart setting forth the general stages of a cycle 400 for utilizing waste heat to generate electricity. The cycle 400 begins at stage 405 with the baffle 306 positioned so that as a cooling fluid passes through the cooling chamber 326, heat in the gas located in the chamber 302 is transferred to the cooling fluid. As the gas in the chamber 302 cools, a spring drives a magnet in the linear alternator 314 in the direction indicated by arrow 402.

Once the magnet in the linear alternator 314 reaches a certain position the cycle 400 proceeds to stage 410. In stage, 410 the magnet 310 is repositioned to cause the baffle 306 to change positions as indicated by arrow 404. While FIG. 4 shows the magnet 310 being repositioned, it should be understood that the magnet 310 may be an electromagnet and to change the baffle's 106 positions, various magnets may be activated and deactivated (See FIG. 5).

Once the baffle 306 has changed positions, the cycle 400 proceeds to stage 415. In stage 415, the hot exhaust in the heat source 324 will heat the gas in the chamber 302. As the gas in the chamber 302 absorbs waste heat, it will expand and drive the magnet in the linear alternator 314 in the direction of arrow 408 thereby generating AC electricity.

Once the magnet in the linear alternator 314 reaches a certain position the cycle 400 proceeds to stage 420. In stage 420, the magnet 310 is repositioned to cause the baffle 306 to change positions as indicated by arrow 412. After the baffle 306 has changed positions, the cycle 400 proceeds to stage 405 where the cycle 400 begins again.

Figure 5:
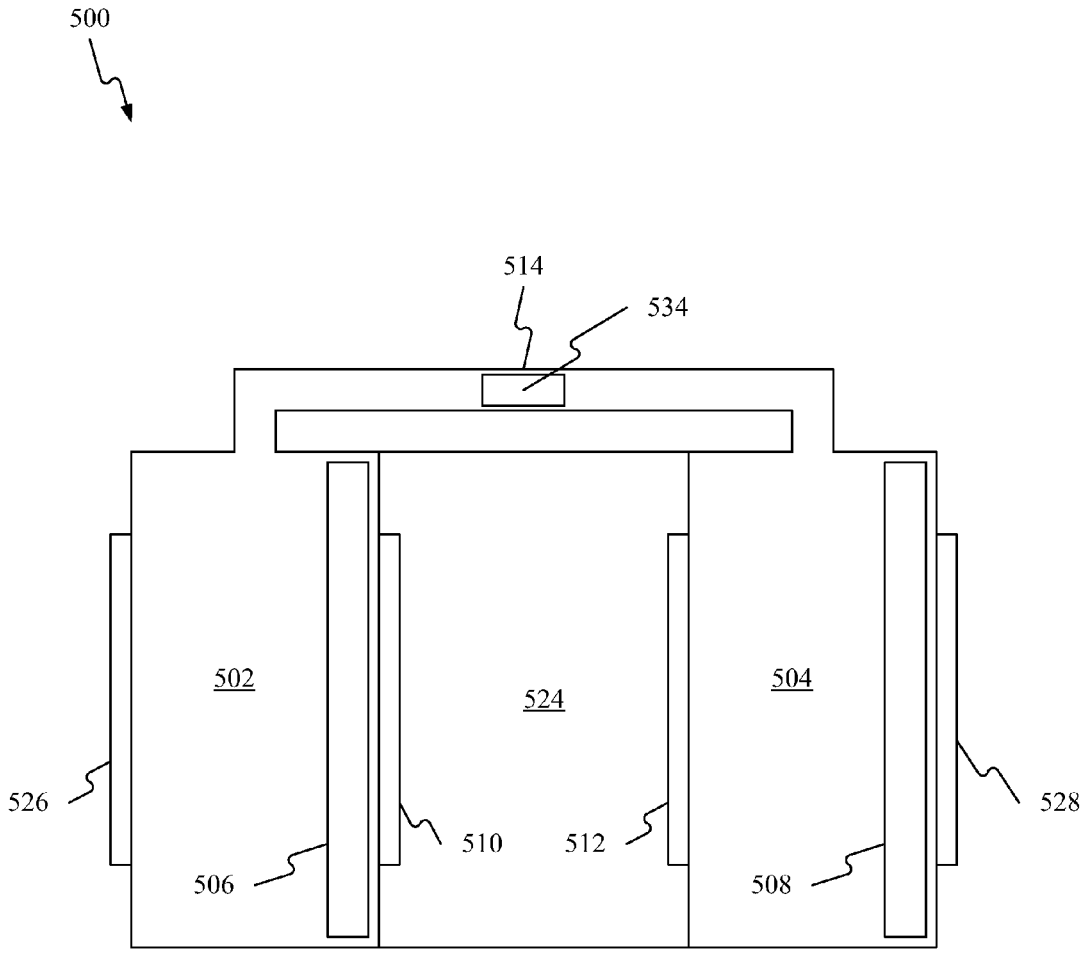
FIG. 5 is a diagram of a second dual chamber engine for utilizing waste exhaust heat to generate electricity.

FIG. 5 illustrates a second dual chamber engine 500 for utilizing waste exhaust heat to generate electricity. The dual chamber engine 500 includes two chambers 502 and 504, two slides 506 and 508, magnets 510, 512, 526, and 528, and a linear alternator 514. The chambers 502 and 504 are connected via the linear alternator 514. In addition, passing between the chambers 502 and 504 is an exhaust conduit 524 (e.g. a flue). As stated above with regards to FIG. 1, regenerators and sensors may be used to increase heat transfer efficiencies and control positioning of the slides 506 and 508.

In other embodiments, movement of the slides in a parallel action may be controlled by electromagnets or magnets on turntables. The turntables may be both above and below the chambers 502 and 504. Also note that there are a variety of displacer configurations. Non-limiting example include a pivoted rectangular displacer inside a V-shaped chamber, and a pie-slice shaped displacer in a rectangular sectioned chamber where the movement is not a pivot but a rocking action.

Note that while FIG. 5 depicts the slides 506 and 508 having a rectangular shape, the slides 506 and 508 may be of differing shape such as, but not limited to, various curved shapes. As described above with respect to FIG. 1 when the slides 506 and 508 change position, the working fluid flows from one side of the chambers 502 and 504, respectively. The magnets 510, 512, 526, and 528 are electromagnets. In addition, the magnets 510, 512, 526, and 528 may be stationary or movable. The operation of the dual chamber engine 500 will be described in greater detail below with respect to FIG. 2.

Figure 6:
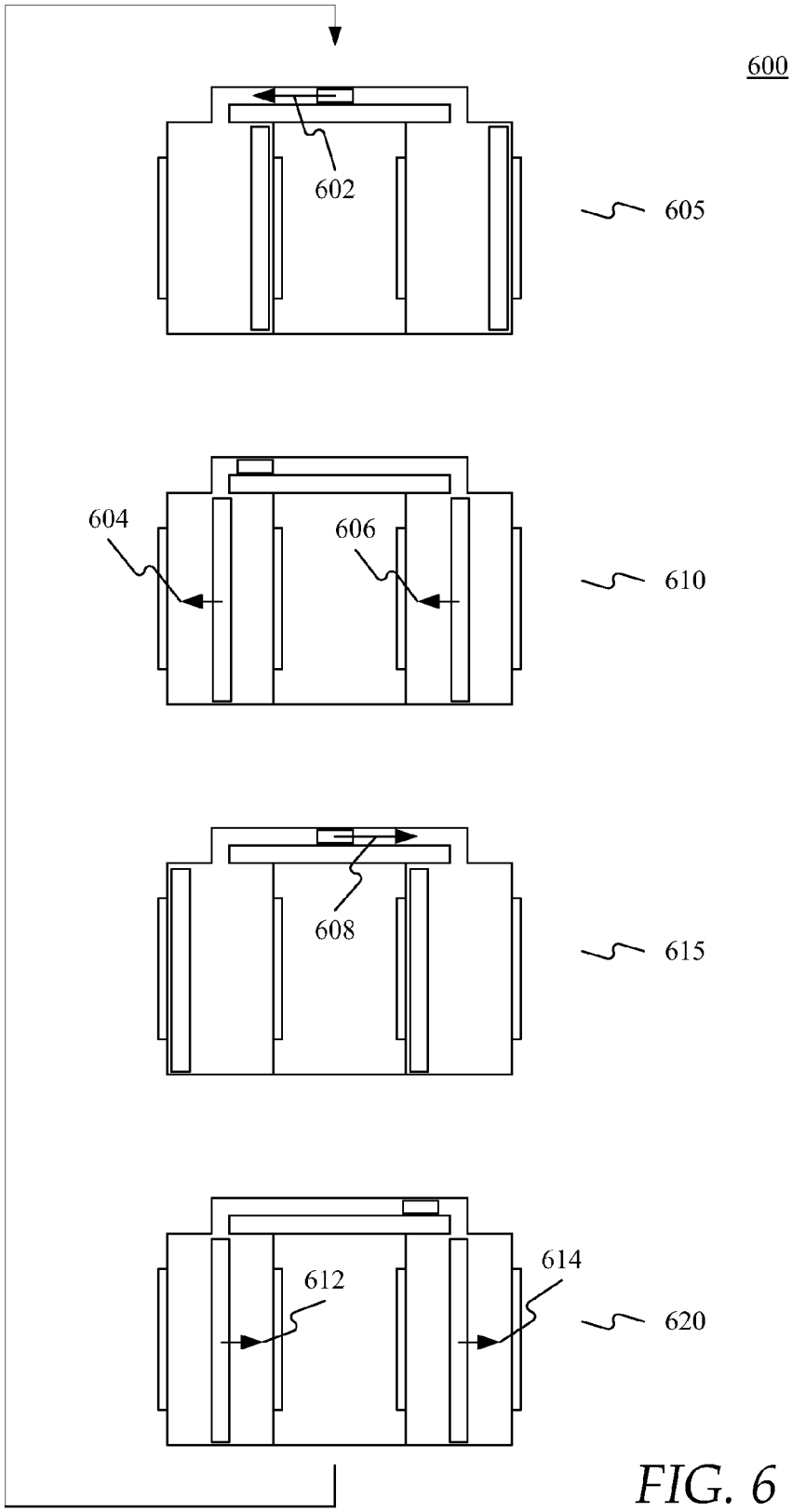
FIG. 6 is a flow chart of a cycle for utilizing waste heat to generate electricity.

The operation of the dual chamber engine 500 may be described with reference to FIG. 6. The cycle 600 begins at stage 605 with the slides 106 and 108 positioned so that as hot exhaust passes through the exhaust conduit 524, heat is transferred from the exhaust to a gas located in the chamber 504. While the gas in chamber 504 is being heated by the exhaust, the gas in chamber 502 is being cooled. As the gas in the chamber 504 is heated by the hot exhaust, the gas expands. Simultaneously, the gas in chamber 502 contracts due to cooling. This combination of expansion/contraction causes the working fluid to flow through the linear alternator from chamber 504 to chamber 502 causing a magnet 534 of the linear alternator 514 to slide toward chamber 502 in a direction 602 thereby generating electricity.

Once the magnet in the linear alternator 514 reaches a certain position, the cycle 600 proceeds to stage 610. In stage 610, the electromagnets 510 and 512 de-energize or change polarity and the electromagnets 526 and 528 energize to cause the slides 506 and 508 to change positions as indicated by arrows 604 and 606. In other aspects of the disclosure, positioning of the baffles 106 and 108 may be controlled by sensors. The sensors monitor the pressure of the working fluid, or position of the linear alternator's 514 magnet 534. The sensors may receive power from the linear alternator 514.

Once the slides 506 and 508 have changed positions, the cycle 600 proceeds to stage 615. In stage 615, the hot exhaust in the exhaust conduit 524 will heat the gas in the chamber 502, while the working fluid in chamber 504 looses heat and contracts. As the gas in the chamber 502 absorbs waste heat, it will expand and drive the magnet 534 in the linear alternator 514 in the direction of arrow 608 thereby generating AC electricity.

Once the magnet 534 in the linear alternator 514 reaches a certain position the cycle 600 proceeds to stage 620. In stage, 620 the electromagnets 526 and 528 de-energize and the electromagnets 510 and 512 energize to cause the slides 506 and 508 to change positions as indicated by arrows 612 and 614. After the slides 506 and 508 have changed positions, the cycle 600 proceeds to stage 605 where the cycle 600 begins again.

For example, the cycle 600 begins at stage 605 with the slides 506 and 508 positioned so that as hot exhaust passes through the exhaust conduit 524, heat is transferred from the exhaust to a gas located in the chamber 504. While the exhaust is heating the gas in the chamber 504, the gas in the chamber 502 is being cooled. As the gas in the chamber 504 receives heat from the hot exhaust, working fluid (e.g. air) flow from the chamber being heated to the chamber being cooled causes a magnet located in the linear alternator 514 to move in the direction of arrow 202 and generate electricity.

Once the magnet in the linear alternator 514 reaches a certain position the cycle 600 proceeds to stage 610. In stage 610, the magnets 510 and 512 are deactivated and the magnates 526 and 528 are activated to cause the slides 506 and 508 to change positions as indicated by arrows 604 and 606.

Once the slides 506 and 508 have changed positions, the cycle 600 proceeds to stage 615. In stage 615, the hot exhaust in the exhaust conduit 524 will heat the gas in the chamber 502. As the gas in the chamber 502 absorbs waste heat, it will expand and drive the magnet in the linear alternator 514 in the direction of arrow 608 thereby generating AC electricity.

Once the magnet in the linear alternator 514 reaches a certain position the cycle 600 proceeds to stage 620. In stage 620, the magnets 510 and 512 activate and the magnets 526 and 528 deactivate to cause the slides 506 and 508 to traverse the chambers 502 and 504, respectively, as indicated by arrows 612 and 614. After the slides 506 and 508 have changed positions, the cycle 600 proceeds to stage 605 where the cycle 600 begins again.

Figure 7:
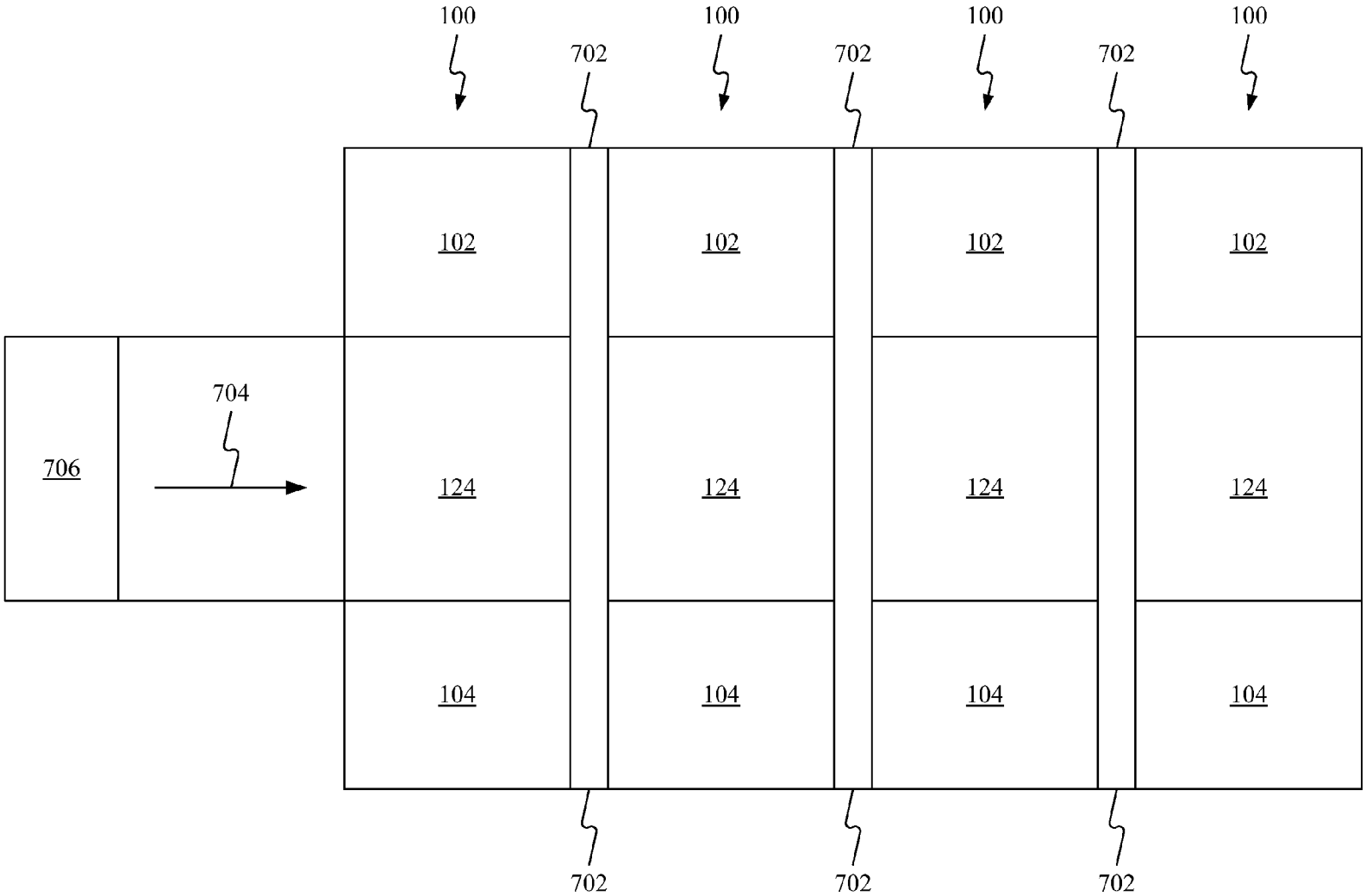
FIG. 7 is a diagram of an operative environment for an engine for utilizing waste exhaust heat to generate electricity.

FIG. 7 shows an operating environment for the dual chamber engine 100. The setup shown in FIG. 7 includes four dual chamber engines 100 arranged in line. Examples of the operating environment include, but are not limited to, an automobile exhaust system, exhaust system of internal combustion engines, cooling systems, etc. For example, when the dual chamber engine 100 is used as the exhaust system of an internal combustion engine 706, the hot working fluid may flow through flue 124 as indicated by arrow 704. In other aspects of the disclosure, coolant from an automobile engine may flow from the automobile's engine through heat sink exchange surfaces associated with each engine 100 to dissipate heat before flowing to the automobile's radiator, or some dedicated heat exchange/cooling arrangement.

Another example of an operating environment may include an exhaust system. For this environment, an array of the dual chamber engines 100 may act as flues with catalytic materials or catalytic cores in the flue 124 to form a power generating catalytic converter for vehicles with internal combustion engines. For example, catalytic materials may include, but are not limited to platinum, palladium, rhodium, cerium, iron, manganese, copper, and nickel. In addition, the use of sound absorbing materials may be attached to spacers (upper side and lower side of 124 (125, and 127) forming the flue 124 of the dual chamber engines 100 to form the exhaust pipe and thus forming a power generating muffler. For example, the dual chamber engine 100 can be incorporated along the length of an exhaust system of an engine (e.g., along exhaust piping such as a tail pipe, catalytic converter housing, diesel particulate filter housing, muffler bodies or other components of an exhaust system). The engine can be a stationary engine or an engine on a vehicle.

In another operating environment, the dual or single chamber engine 100 may be used with solar concentrators. The solar concentrators may concentrate solar energy onto surface 128 to heat the fluids in chambers 102 and 104. A cooling fluid (e.g., water or air) may be used to dissipate heat via surfaces 126.

In addition, multiple chambers may drive a single linear alternator. In other words, the heat exchange surface may be very large so the linear alternator output is maximized. In other embodiments a large heat exchange surface area may allow the system to work with a small temperature differential. In yet other embodiments, a flue with multiple single or dual chamber engines 100 (e.g. a 2×2 chamber) so that all internal surfaces are providing for energy capture.

Reference may be made throughout this specification to "one embodiment," "an embodiment," "embodiments," "an aspect," or "aspects" meaning that a particular described feature, structure, or characteristic may be included in at least one embodiment of the present invention. Thus, usage of such phrases may refer to more than just one embodiment or aspect. In addition, the described features, structures, or characteristics may be combined in any suitable manner in one or more embodiments or aspects. Furthermore, reference to a single item may mean a single item or a plurality of items, just as reference to a plurality of items may mean a single item. Moreover, use of the term "and" when incorporated into a list is intended to imply that all the elements of the list, a single item of the list, or any combination of items in the list has been contemplated.

One skilled in the relevant art may recognize, however, that the invention may be practiced without one or more of the specific details, or with other methods, resources, materials, etc. In other instances, well known structures, resources, or operations have not been shown or described in detail merely to avoid obscuring aspects of the invention.

While example embodiments and applications of the present invention have been illustrated and described, it is to be understood that the invention is not limited to the precise configuration and resources described above. Various modifications, changes, and variations apparent to those skilled in the art may be made in the arrangement, operation, and details of the methods and systems of the present invention disclosed herein without departing from the scope of the claimed invention.

The above specification, examples, and data provide a description of the manufacture, operation and use of the invention. Since many embodiments of the invention can be made without departing from the spirit and scope of the invention, the invention resides in the claims hereinafter appended.

What is claimed is:

1. A system for generating power, the system comprising:

a first chamber comprising a first side, a second side, a first top surface, and a first bottom surface, the first side located adjacent to a heat source and the second side adjacent to a heat sink;

a first displacer comprising a first pivot surface, the first displacer located inside the first chamber and pivotable about a first point located on the first bottom surface;

a first magnet located outside the first chamber and proximate the first pivot surface; and a linear alternator in fluid communication with the first chamber.

2. The system of claim 1, wherein the magnet is mounted on a turntable.

3. The system of claim 1, further comprising:

a second chamber comprising a third side, a fourth side, a second top surface, and a second bottom surface, the third side located adjacent to the heat source, and the fourth adjacent to a heat sink, the second chamber in fluid communication with the linear alternator via a second hole in the second top surface;

a second displacer comprising a second pivot surface, the second displacer located inside the second chamber and pivotable about a second point located on the second bottom surface;

a second magnet located outside the second chamber and proximate the second pivot surface.

4. The system of claim 1, wherein the first magnet is an electromagnet.

5. The system of claim 4, wherein the electromagnet are in electrical communication with the linear alternator.

6. The system of claim 1, wherein the top and bottom surfaces comprise a regenerator.

7. The system of claim 6, wherein the regenerator comprises a plurality of fins or a plurality of extended surfaces.

8. The system of claim 1, wherein the heat source comprises exhaust gases from an internal combustion engine.

9. The system of claim 8, wherein the exhaust gases are confined by a third top surface and a third bottom surface.

10. The system of claim 9, wherein sound absorbing and heat insulating materials are attached to the third top and bottom surfaces.

11. The system of claim 9, wherein catalytic elements are included in the exhaust flue.

12. A system for generating electrical energy, the system comprising:

a first chamber comprising a first side, a first top surface, and a first bottom surface, the first side located adjacent to a heat source;

a second chamber comprising a second side, a second top surface, and a second bottom surface, the second side located adjacent to the heat source;

a first displacer comprising a first pivot surface, the first displacer located inside the first chamber and displaceable within the first chamber to be positioned against either heated or cooled surfaces;

a second displacer comprising a second pivot surface, the second displacer located inside the second chamber and displaceable within the second chamber;

a first magnet located outside the first chamber and proximate the first displacer;

a second magnet located outside the second chamber and proximate the second displacer; and a linear alternator in fluid communication with the first top surface via a first opening in the first top surface and in fluid communication with the second top surface via a second opening in the second top surface.

13. The system of claim 12, wherein the first magnet is movable about the first chamber and the second magnet is movable about the second chamber.

14. The system of claim 12, wherein the first magnet and second magnet are each electromagnets.

15. The system of claim 14, wherein the first magnet and the second magnet are in electrical communication with the linear alternator.

16. The system of claim 12, wherein the top and bottom surfaces comprise a regenerator.

17. The system of claim 12:

wherein the first displacer being displaceable within the first chamber comprises the first displacer having a first pivot surface and the first displacer being attached to the first bottom surface and pivotable about a first pivot point via the first pivot surface; and wherein the second displacer being displaceable within the second chamber comprises the second displacer having a second pivot surface and the first displacer being attached to the second bottom surface pivotable about a second pivot point via the second pivot surface.

18. A system for generating power, the system comprising:

a first chamber comprising a first side located adjacent to a heat source and a first top surface;

a second chamber comprising a second side located adjacent to the heat source and a second top surface;

a linear alternator in fluid communication with the first top surface via a first opening in the first top surface and the second top surface via a second opening in the second top surface;

a first valve in fluid communication with the linear alternator and the first opening, the first valve located between the linear alternator and the first opening; and a second valve in fluid communication with the linear alternator and the second opening, the second valve located between the linear alternator and the second opening.

19. The system of claim 18, further comprising a timer operatively connected to the first valve and the second valve.

20. The system of claim 19, wherein the timer is electrical and receives electricity from the linear alternator.

21. The system of claim 18, further comprising a sensor operatively connected to the first valve and the second valve.

22. The system of claim 21, wherein the sensor is electric and receives electricity from the linear alternator.

23. The system of claim 18, wherein the top and bottom surfaces comprise a regenerator.

24. A system for generating power, the system comprising:

a chamber defining an internal volume containing a gas, the chamber including a heating surface and a cooling surface;

a gas displacer positioned within the chamber, the displacer being moveable between a first position in which the gas within the volume of the chamber is heated by the heating surface and a second position in which the gas within the volume of the chamber is cooled;

a displacer positioning mechanism for moving the displacer between the first and second positions;

a generator having a driven element positioned outside the chamber;

wherein when the gas displacer is in the first position, the expansion of the heated gas within the volume of the chamber drives the driven element in a first direction; and wherein when the gas displacer is in the second position, the driven element moves in a second direction opposite from the first direction.

25. The system of claim 24, wherein the gas displacer is not moved by the expansion/contraction of gas within the chamber.

26. A system for generating power, the system comprising:

first and second gas chambers each including a heating surface adapted to be positioned adjacent to a heat source, each gas chamber also including a cooling surface;

first and second gas displacers respectively positioned within the first and second gas chambers, the first and second gas displacers being moveable between first positions in which gas within the first and second chambers is heated by the heating surfaces and second position in which gas within the first and second chambers is cooled by the cooling surfaces;

a positioning mechanism for moving the first and second gas displacers between the first and second positions, the positioning of the first and second gas displacers being coordinated such that when the first gas displacer is in the first position, the second gas displacer is in the second position, and when the first gas displacer is in the second position, the second gas displacer is in the first position;

a generator including a conduit that provides fluid communication between the first and second chambers, the generator including a driven element positioned within the conduit, wherein when the first gas displacer is in the first position and the second gas displacer is in the second position, gas flows through the conduit from the first chamber toward the second chamber thereby driving the driven element in a first direction, and wherein when the first gas displacer is in the second position and the second gas displacer is in the first position, gas flows through the conduit from the second chamber toward the first chamber thereby driving the driven element in a second direction opposite from the first direction.

* * * * *